US005286212A

United States Patent [19]

Broeksteeg

[11] Patent Number: 5,286,212

[45] Date of Patent: Feb. 15, 1994

[54] SHIELDED BACK PLANE CONNECTOR

[75] Inventor: Johannes M. Broeksteeg, Oss, Netherlands

[73] Assignee: The Whitaker Corporation, Wilmington, Del.

[21] Appl. No.: 27,992

[22] Filed: Mar. 8, 1993

[30] Foreign Application Priority Data

Mar. 9, 1992 [GB] United Kingdom ..... 9205087.1

[51] Int. Cl.[5] ..... H01R 13/648

[52] U.S. Cl. ..... 439/108; 439/609

[58] Field of Search ..... 439/108, 609

[56] References Cited

U.S. PATENT DOCUMENTS 5,066,236 11/1991 Broeksteeg ..... 439/108 X
5,137,472 8/1992 Hillbish .
5,141,445 8/1992 Little ..... 439/108
5,228,871 7/1993 Goodman ..... 439/108 X

FOREIGN PATENT DOCUMENTS 0347097 12/1989 European Pat. Off. .
2163305A 2/1986 United Kingdom .

*Primary Examiner*—Eugene F. Desmond
*Attorney, Agent, or Firm*—Eric J. Groen

[57] ABSTRACT

A shielded back plane connector is disclosed comprising a header assembly and a daughter board connector. The daughter board connector includes an upper and lower shield where the upper and lower shields include stamped windows thereby forming passages for allowing structural ribs of the housing to pass therethrough while providing a contact for contact with grounding pins disposed in the header assembly. A cross talk shield can be positioned intermediate each of the terminal sub-assemblies thereby reducing the cross talk between adjacent terminals. A shield includes a contact portion for contacting the centre terminal in the shielded sub-assembly, for using the centre terminal as a ground terminal.

3 Claims, 8 Drawing Sheets

SHIELDED BACK PLANE CONNECTOR

BACKGROUND OF THE INVENTION

1. Field of the Invention

The subject invention relates to a shielded back plane connector which can be mounted to a back plane, which receives a shielded daughter card connector.

2. Description of the Prior Art

It is common in electronic architecture to provide for a header connector having a plurality of male pins to be mounted to a mother board connector. A daughter board connector is mounted to a daughter card and is profiled for receipt within the header connector, the daughter board connector having a plurality of receptacle sockets for electrical connection with the male pins in the header. It is also known to shield the mother board connector and the daughter board connector to improve their EMI/RFI characteristics for example, EP Patent application 0,422,785 shows such an assembly, where the shielded back plane connector can be interconnected to a shielded daughter board connector. One of the necessities which has been presented in this technology has been to reduce the size requirements of the overall packaged system.

The object of the invention then is to provide for a shielded back plane assembly having overall reduced dimensions, without compromising on other characteristics such as EMI/RFI, signal speed, and the like.

SUMMARY OF THE INVENTION

The objects were accomplished by providing a high density shielded back plane connector comprising a first insulative housing for mounting to a mother board comprising a header having two thin upstanding side walls, the header having a plurality of signal contacts within the header for mating with complementary contacts in a complementary connector. The thin side walls have strengthening ribs on an inside surface to rigidify the upstanding side walls and a plurality of ground contacts intermediate at least some of the strengthening ribs. A shielded daughter board connector is adapted to electrically mate with the mother board electrical connector, the daughter board comprising an insulative housing having a plurality of signal contacts adapted to mate with the mother board signal contacts. The daughter board further comprises an upper and lower shield member positioned over outer side walls of the daughter board housing, where each shield member includes an outwardly projecting kink along a front edge thereof, thereby forming a ground shield contact for mating with the ground tabs in the header. The ground shields include openings on opposite sides of the ground shield contacts, whereby the openings form a passage to receive the strengthening ribs therein while the ground shield contacts project between the ribs to make electrical contact with the header ground contacts.

BRIEF DESCRIPTION OF THE DRAWINGS

FIG. 6 is a cross-sectional view through lines 6—6 of FIG. 5;

DETAILED DESCRIPTION OF THE PREFERRED EMBODIMENT

Figure 1:
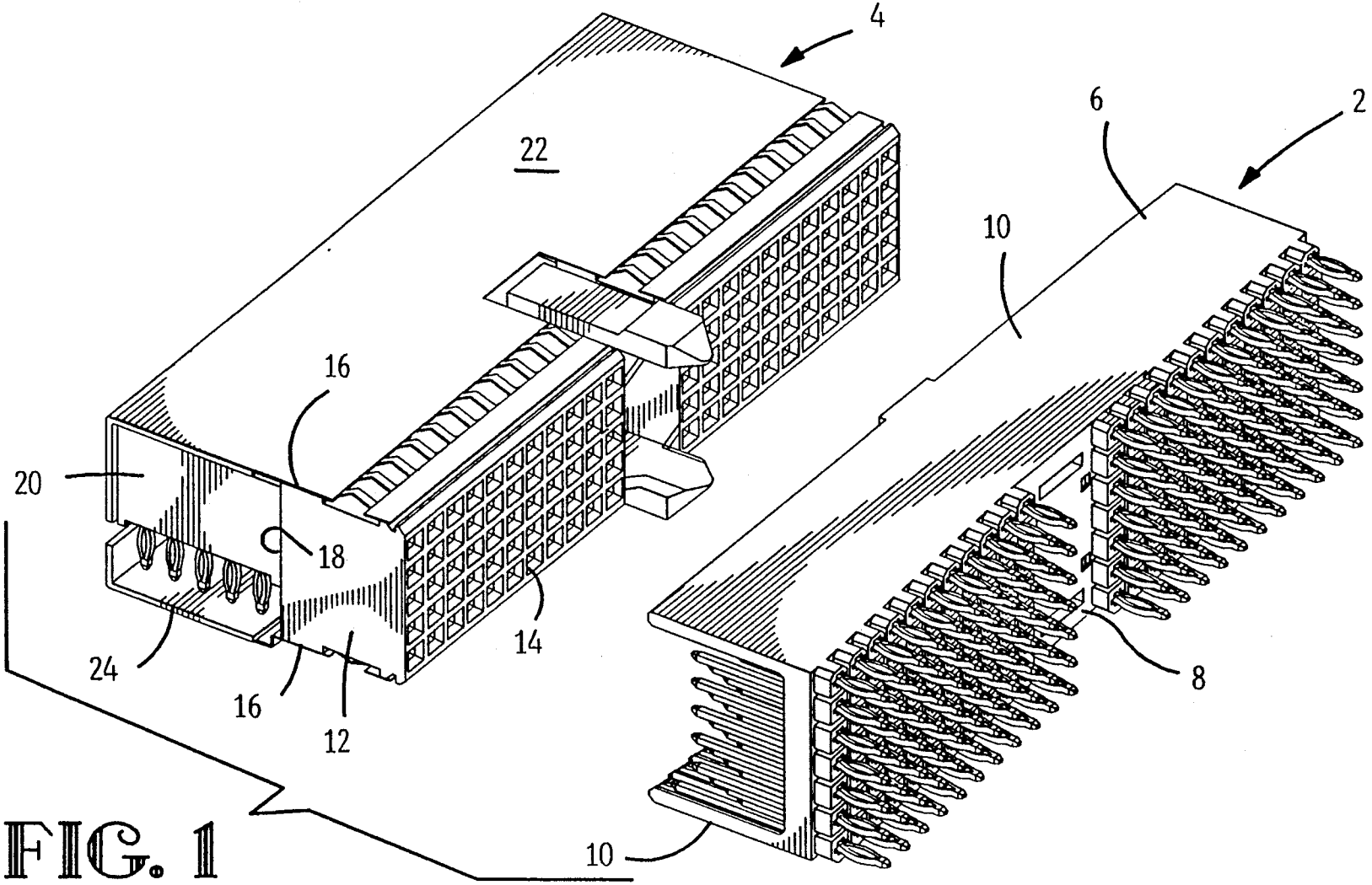
FIG. 1 is an isometric view of the shielded daughter board connector exploded from the complementary header.

FIG. 1 is an isometric view of a header connector shown generally at 2 and a shielded daughter card connector shown generally at 4. The header assembly 2 is generally comprised of an insulating housing 6 having a lower surface 8 for mounting to a mother board and side walls 10 upstanding from the floor portion 8. With reference still to FIG. 1, the daughter board connector 4 is generally comprised of a forward housing portion 12 having a front mating face 14 side surfaces 16 and a rear surface 18. A plurality of terminal sub-assemblies 20 are shown assembled to the housing 12 and encapsulated in upper and lower shield members 22, 24 respectively.

Figure 2:
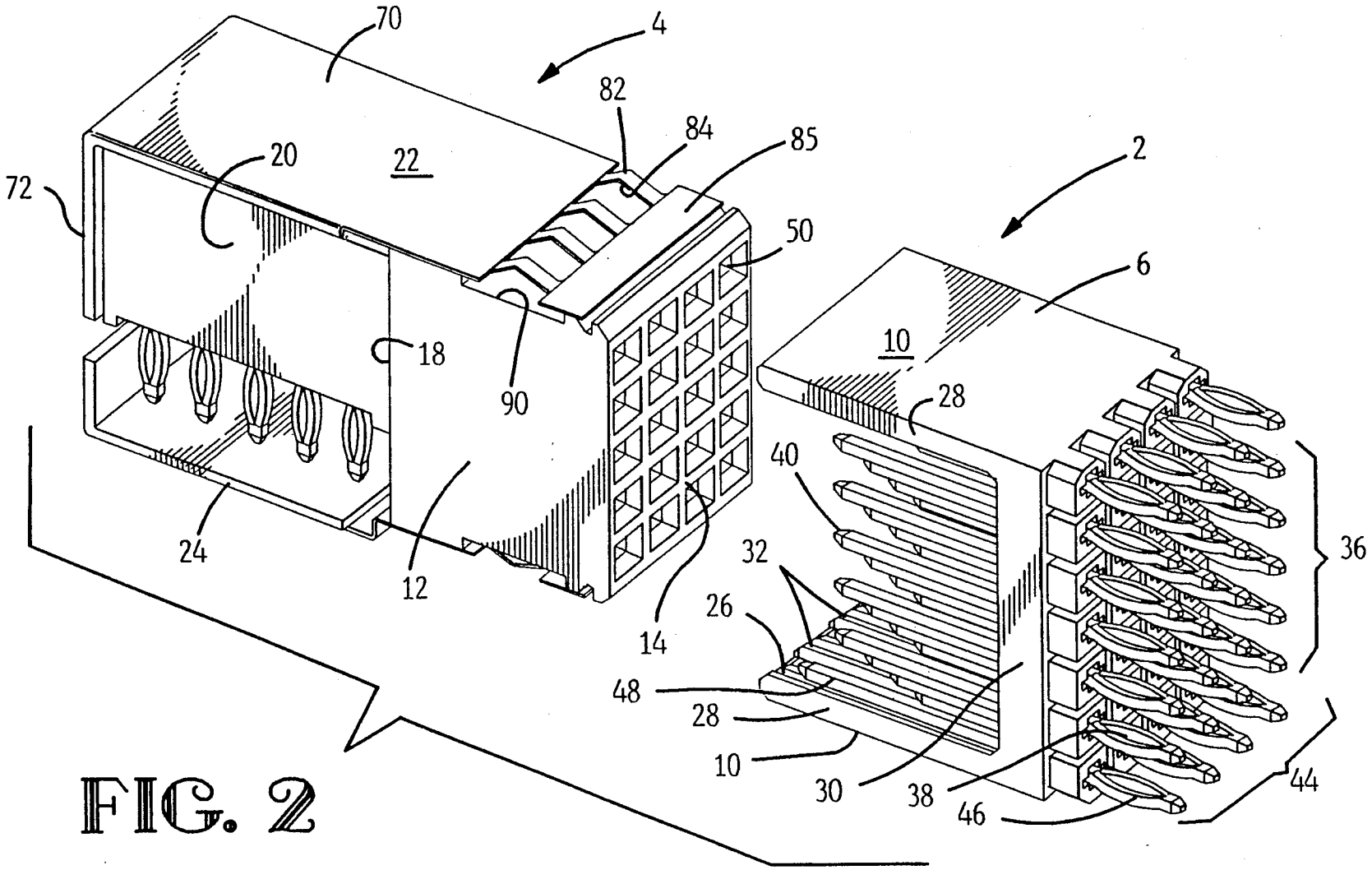
FIG. 2 is an isometric view of an enlarged section of the connectors shown in FIG. 1.

With reference now to FIG. 2, the header assembly 2 and daughter board assembly will be described in greater detail, where FIG. 2 is an enlarged section of the assemblies shown in FIG. 1. As shown in FIG. 2, the header housing 6 has side walls 10 comprised of thin side wall sections 26 having end strengthening ribs 28 and 30. Along the length of the thin side wall section 26, a plurality of strengthening ribs 32 are positioned integral with the sidewall 10 to rigidify these thin side wall sections. The header assembly 2 further comprises a plurality of signal contacts 36 having compliant pin portions 38 extending outwardly from the floor 8 and further include male pin portions 40 positioned within the header intermediate the side walls 10. The header assembly 2 further comprises a plurality of grounding contacts 44 having compliant pin portions 46 and a grounding pin portion 48 positioned between strengthening ribs 32.

Figure 3:
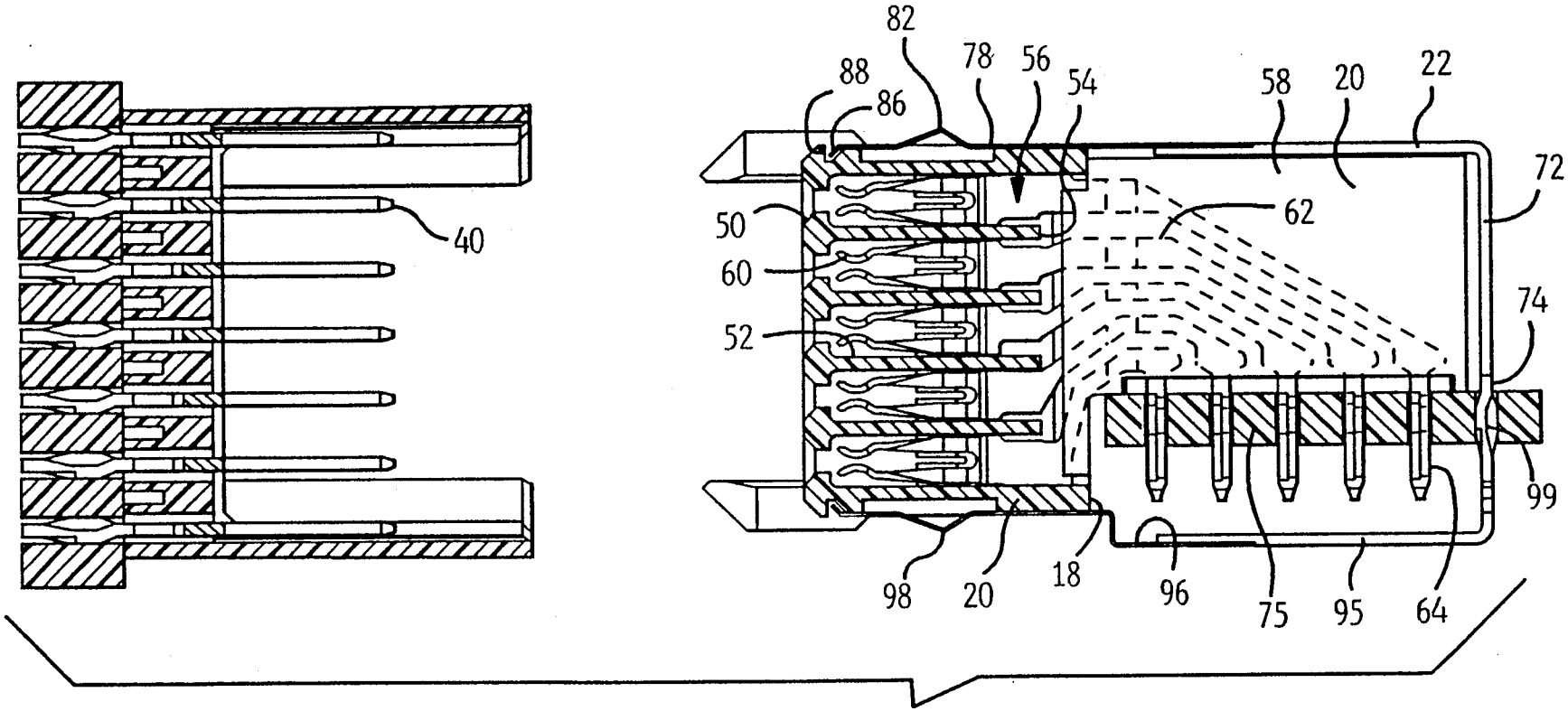
FIG. 3 is a cross-sectional view through the connector of FIG. 1 or 2 showing the internal structure thereof.

With reference now to FIGS. 2 and 3, the daughter board connector 4 will be described in greater detail. Housing 112 includes a plurality of signal pin contact receiving openings shown at 50 leading into a terminal receiving passageway 52, the passageway 52 extending rearwardly to a face 54. A plurality of terminal subassemblies 20 are positioned against the housing 20 where each subassembly includes a plurality of electrical terminals 56 encapsulated in an overmoulded web of plastic material 58. Each contact 56 includes a receptacle portion 60 for mating contact with the male signal pins 40 and further comprises an intermediate portion 62 and compliant pin portions 64.

With reference again to FIG. 2, the upper shield 22 includes an upper plate portion 70 for positioning above the housing portion 12 and above the terminal subassemblies 20. The upper shield member 22 further includes a rear plate portion 72 for positioning behind the terminal subassemblies 20, the rear plate portion 72 including a plurality of integral compliant pin sections 74 for mechanical and electrical connection to a printed circuit board 75, as shown in FIG. 3. The upper shield member 22 further includes a thin plate portion 78 (FIG. 3) formed by a premilling operation to reduce the thickness of the shield portion over the housing 20 to reduce the overall width dimension of the shielded data board connection. As shown in FIG. 2, the upper shield 22 is kinked adjacent to the front mating face 14 to form projections 82 extending above the plane formed by the upper plate portion 70. A plurality of windows 84 are stamped from the upper plate portion 70 whereby the windows are laterally positioned to receive the strengthening ribs 32 therein, while the projections 82 form shield contacts, which span the strengthening ribs 32, for mating with the ground pins 48. To rigidify the plurality of shield contacts 82 a strengthening strap 85 extends transversely of the shields contacts 82 and is held to the housing by a folded front edge 86 positioned in a laterally extending groove 88 (FIG. 3). To improve the resiliency of the shield contacts 82 a laterally extending channel 90 is positioned below the shield contacts 82. The lower shield member 24 is similar to the upper shield portion including a plate portion 95 having a thin wall section 96, shield contacts at 98, and compliant portions 99 for interconnection to the printed circuit board.

Figure 4:
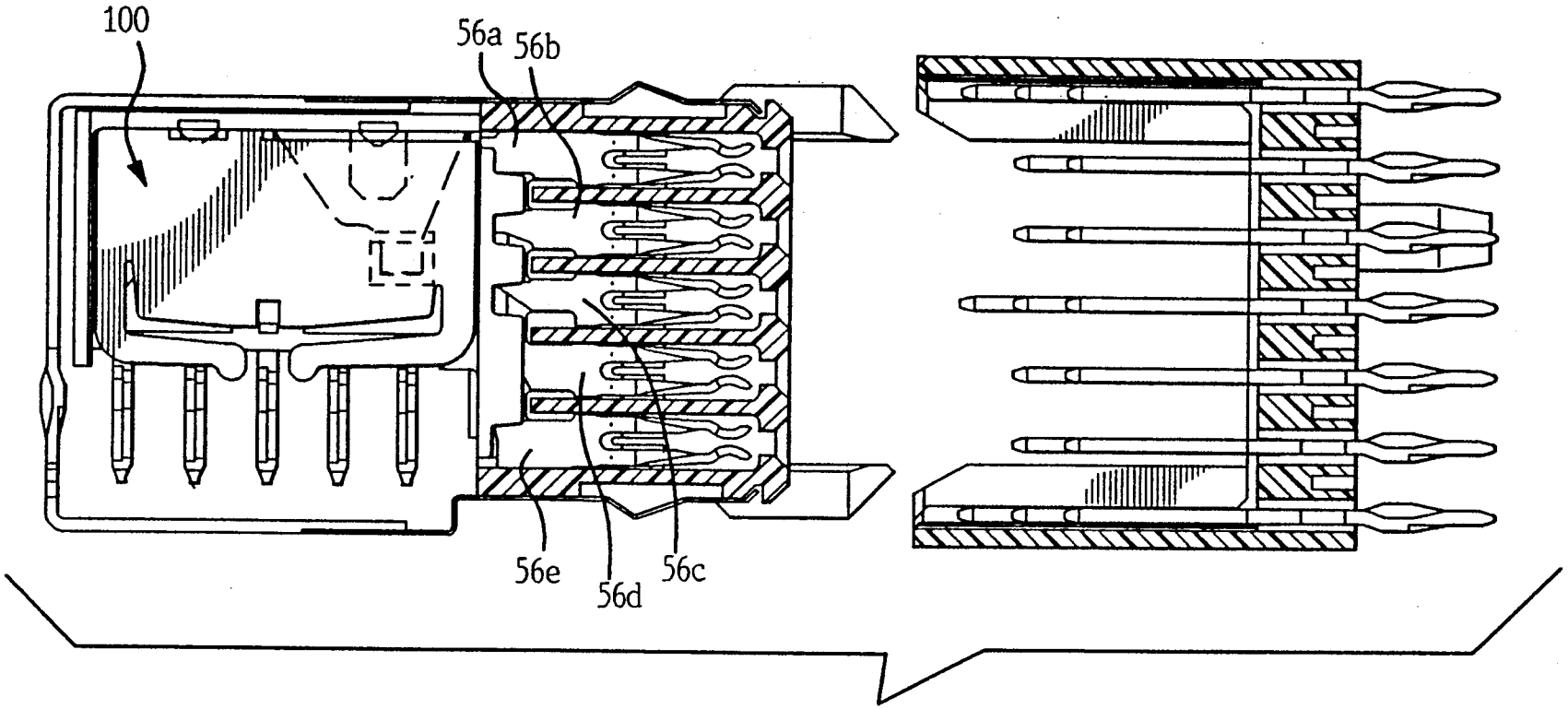
FIG. 4 is a cross-sectional view similar to that of FIG. 3 showing an alternate embodiment having a cross talk shield.

With reference now to FIG. 4, the above mentioned daughter board connector 4 can alternatively be used with an additional shield placed intermediate the plurality of terminal sub-assemblies 20 to reduce the cross talk between the adjacent terminal strips. For this purpose, a cross talk shield 100 can be positioned between each adjacent stacked terminal sub-assembly 20. In the preferred embodiment of the invention the cross talk shield 100 contacts the center terminal 56C leaving terminals 56A, 56B and 56D, 56E for signal contacts thereby forming a modified strip line connector.

Figure 8:
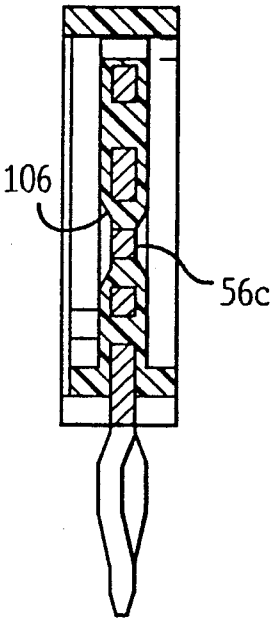
FIG. 8 is a plan view of the cross talk shield in a stamped blank form.
Figure 5:
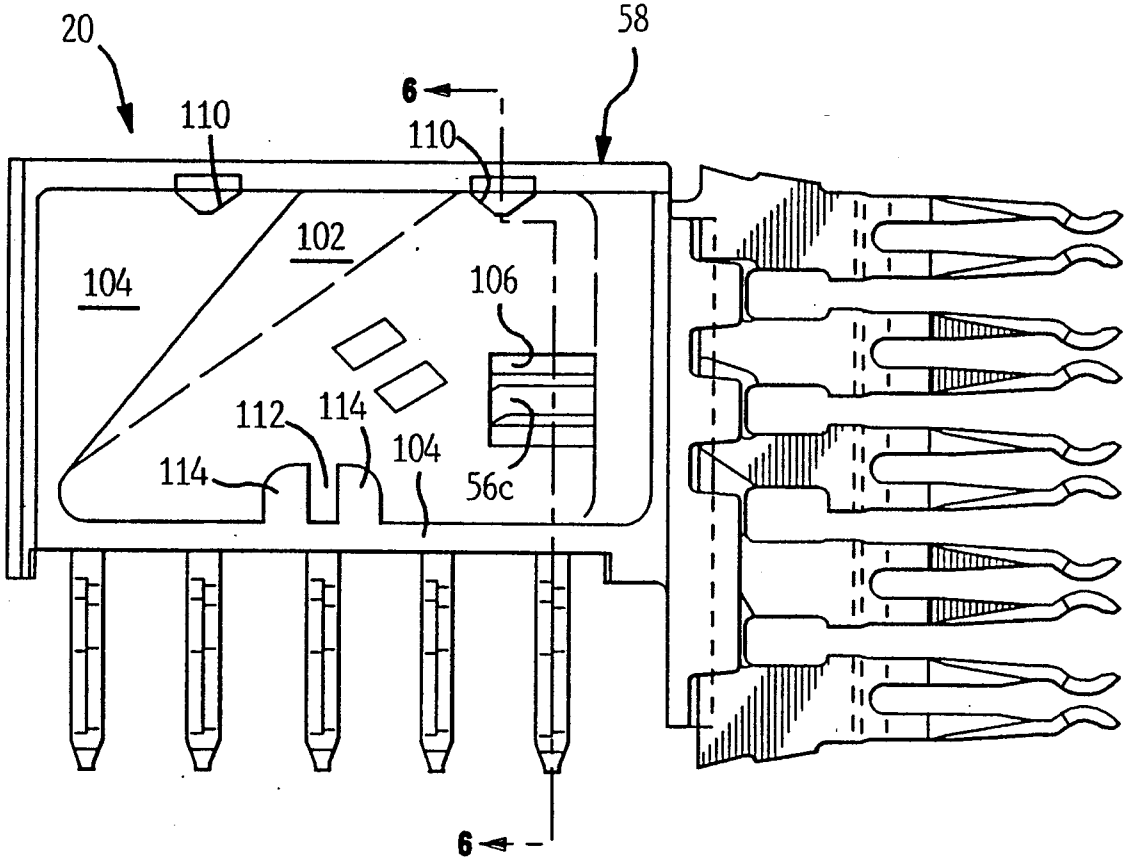
FIG. 5 is a side plan view of the terminal subassembly for use in the embodiment of FIG. 4.
Figure 7:
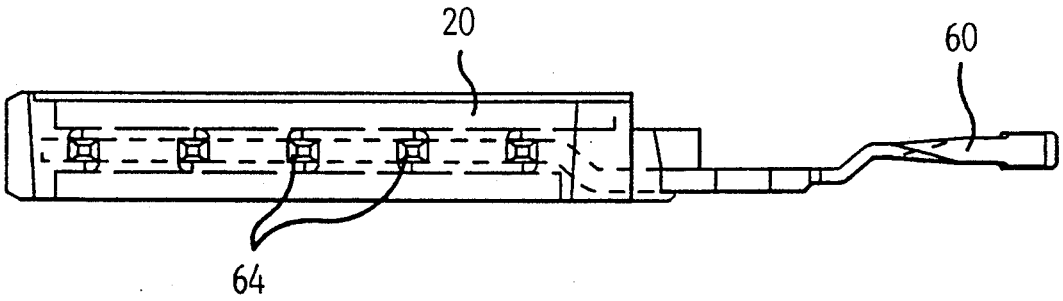
FIG. 7 is a lower plan view of the terminal subassembly shown in FIG. 5.
Figure 8:
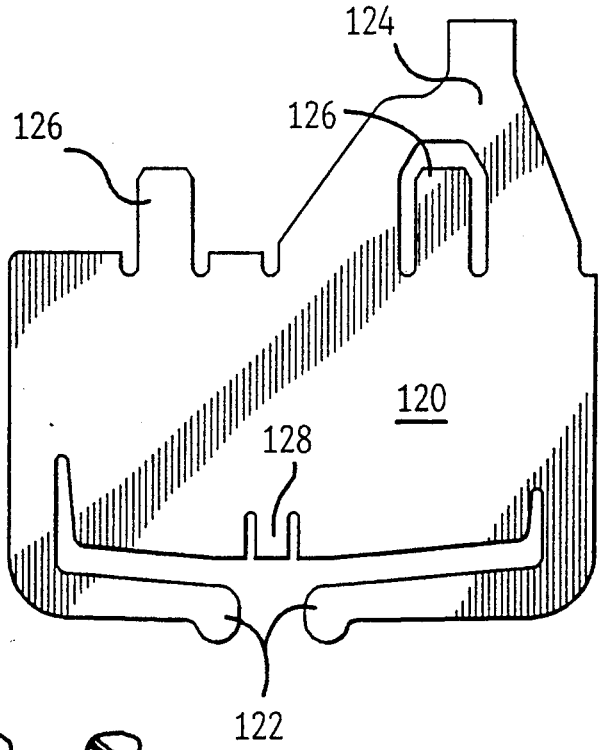
Figure 10:
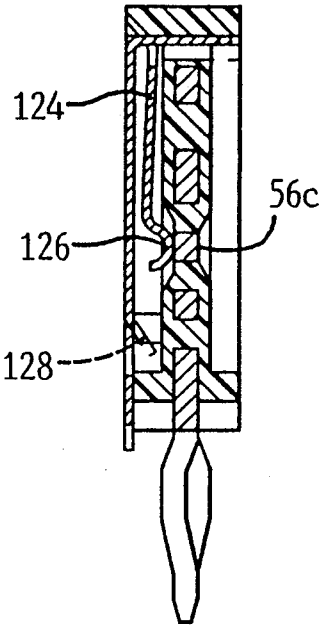
FIG. 10 shows a cross-sectional view of the terminal sub-assembly through lines 10—10.
Figure 9:
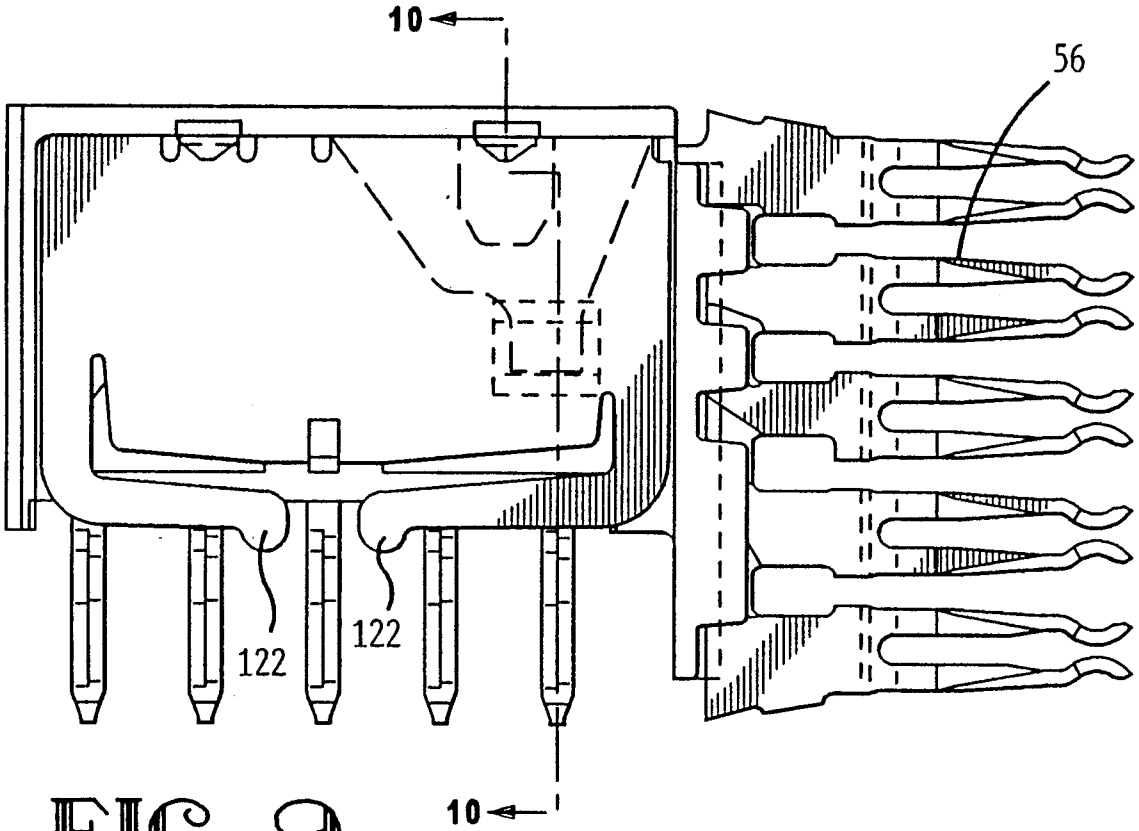
FIG. 9 is a side plan view showing the cross talk shield in place on the terminal sub-assembly.
Figure 11:
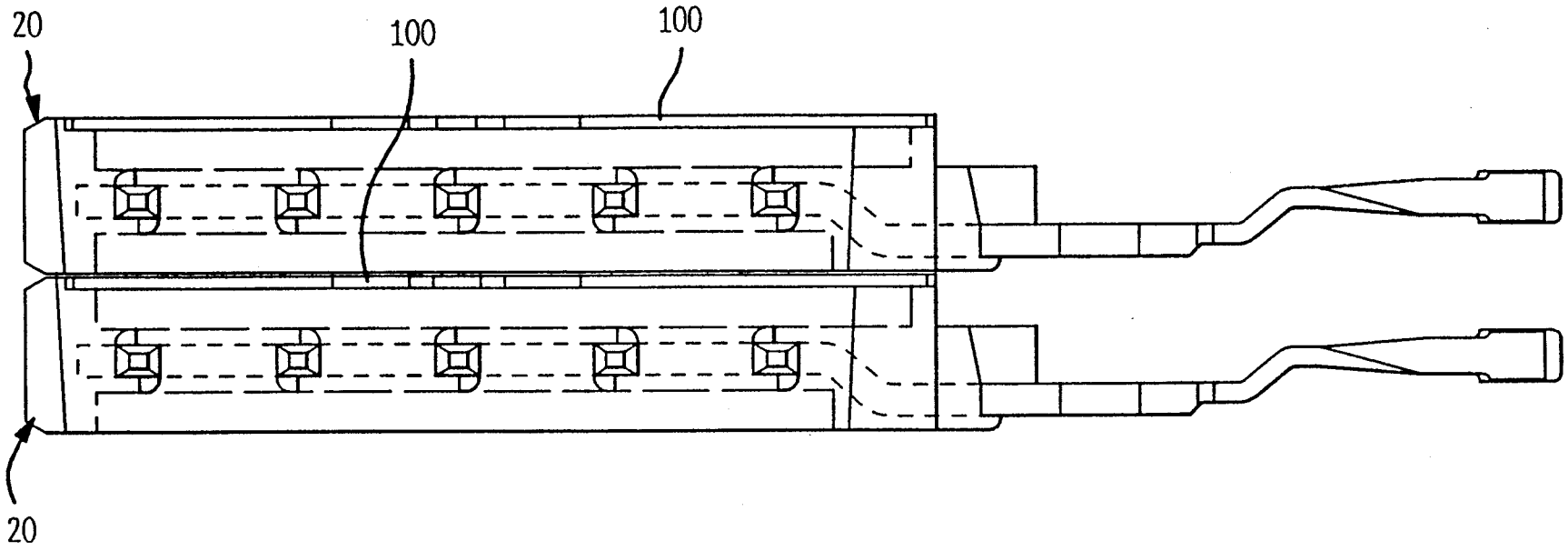
FIG. 11 shows a lower plan view of two of the subassemblies stacked together with the cross talk shield in place.

With reference now to FIG. 5, the shielded subassembly 20 will be described in greater detail for use with the cross talk shield. As mentioned above, the terminal sub-assembly 20 has an overmoulded web of material 58 having a recessed surface at 102 and a raised surface 104. As shown in FIGS. 5 and 6, a window is formed at 106 exposing a portion of the central terminal 56C for contacting with the cross talk shield 100. With reference again to FIG. 5, two apertures are formed through the insulating web 58 at 110 and a lower slot 112 is formed by two upstanding ribs 114 having a thickness equal to the raised portion 104 with the intermediate portion between the slot being recessed to the surface 102. With reference now to FIG. 8, the cross talk shield 100 has a flat plate portion 120 including two lower contact arms 122 for contact with a trace on a printed circuit board, and further comprises an upper contact arm shown at 124. The cross talk shield 100 further comprises locking tabs 126 at an upper edge thereof, and locking tab 128 at a lower edge thereof. As shown in FIG. 10, the cross talk shield is formed with the contact arm 124 bent around an upper edge of the flat plate portion 122, and the end of the contact arm 124 is formed with a Radius section thereby forming a contact surface 126 for contacting the central contact 56C. FIG. 10 also shows cross-talk shield positioned on the surface 104, with the cooperation between the tabs 126 within the openings 110, and shows the tab 128 frictionally held between the two upstanding ribs 114 in the slot thereof. As shown in FIGS. 10 and 11, a plurality of cross talk shields 100 can be placed against the terminal sub-assemblies 20 to reduce the cross talk between adjacent terminal sub-assemblies. The cross-talk shields can be added without increasing the stack thickness of the terminal sub-assemblies and the shields 100.

Advantageously then, as the center line distance between adjacent terminals in adjacent terminal subassemblies 20 has been reduced by half, by the addition of the cross talk shield 100, the impedance has been increased by the formation of the recessed surface 102, thereby providing a pocket of air adjacent to the terminals. Furthermore the ground signal path has been reduced by providing the contact arms 122 adjacent to the daughter board and by providing the contact to the centre terminal 56C.

I claim:

1. A high density shielded backplane connector, comprising:

a first insulative housing for mounting to a mother board comprised of a header having two thin upstanding side walls, said header having a plurality of signal contacts within said header for mating with complementary contacts in a complementary connector, said thin sidewalls having strengthening ribs on an inside surface to ridify said upstanding sidewalls, a plurality of grounding tabs intermediate at least some of said strengthening ribs, and a shielded daughter board electrical connector adapted to electrically mate with said mother board electrical connector, said daughter board connector comprising an insulative housing having a plurality of signal contacts adapted to mate with said mother board signal contacts, said daughter board connector further comprising an upper and lower shield member positioned over outer side walls of said daughter board housing, each said shield member including an outwardly projecting kink along a front edge thereof, thereby forming a ground shield contact for mating with the grounding tabs in said header, said ground shields each including openings on opposite sides of said ground shield contacts, said openings thereby forming a passage to receive said strengthening ribs with said ground shield contacts projecting between said ribs to make electrical contact with said header ground contacts.

2. The backplane connector of claim 1, wherein said openings are formed by stamping windows through said shield members.

3. The backplane connector of claim 1 wherein said upper and lower shield members include a strap portion extending transversely of said openings.

* * * * *